US010059410B2

(12) United States Patent
Boyer et al.

(10) Patent No.: US 10,059,410 B2
(45) Date of Patent: Aug. 28, 2018

(54) FISHING KAYAK

(71) Applicant: PELICAN INTERNATIONAL INC., Laval (CA)

(72) Inventors: Rejean Boyer, Laval (CA); Stephanie Gagnon, Laval (CA)

(73) Assignee: Pelican International Inc., Laval (CA)

( * ) Notice: Subject to any disclaimer, the term of this patent is extended or adjusted under 35 U.S.C. 154(b) by 0 days.

(21) Appl. No.: 15/197,386

(22) Filed: Jun. 29, 2016

(65) Prior Publication Data

US 2018/0001973 A1 Jan. 4, 2018

(51) Int. Cl.
*B63B 35/00* (2006.01)
*B63B 35/71* (2006.01)
(Continued)

(52) U.S. Cl.
CPC ..... *B63B 35/14* (2013.01); *B63B 3/00* (2013.01); *B63B 29/04* (2013.01); *B63B 35/34* (2013.01);
(Continued)

(58) Field of Classification Search
CPC ... B63B 2035/715; B63B 35/34; B63B 35/14; B63B 3/00; B63B 29/04; B63B 35/71; B63B 2035/71
(Continued)

(56) References Cited

U.S. PATENT DOCUMENTS 4,621,587 A * 11/1986 Pool ..... B63B 1/121 114/343
5,061,215 A * 10/1991 Walls ..... B63B 35/58 114/201 R
(Continued)

FOREIGN PATENT DOCUMENTS

CA 2755539 4/2013
WO 00/75007 12/2000
(Continued)

OTHER PUBLICATIONS

2016 Fishing Kayak & Canoe Buyer's Guide—On The Water, http://www.onthewater.com/2016-fishing-kayak-canoe-buyers-guide/, 15 pages.
(Continued)

*Primary Examiner* — Daniel V Venne
(74) *Attorney, Agent, or Firm* — Wolf, Greenfield & Sacks, P.C.

(57) ABSTRACT

A fishing kayak is described comprising a body having a bow end and a stern end the body comprising a deck and a hull. The deck defines a top side of the body of the fishing kayak and the hull defines a bottom side of the body of the fishing kayak. The hull comprises a pontoon hull portion extending from the stern end of the body along a longitudinal axis of the body, the pontoon hull portion being comprised of two pontoon members positioned in an opposing relationship, the pontoon hull portion defining a concave recess to form a tunnel structure. The hull also comprises a convex hull portion extending from the bow end of the body along the longitudinal axis, the convex hull portion being comprised of a convex hull member. The two pontoon members converge into the convex hull portion to form at least in part the convex hull member.

37 Claims, 10 Drawing Sheets

(51) Int. Cl.

| | |
|---|---|
| ***B63B 35/14*** | (2006.01) |
| ***B63B 29/04*** | (2006.01) |
| ***B63B 35/34*** | (2006.01) |
| ***B63B 3/00*** | (2006.01) |

(52) U.S. Cl.
CPC ..... *B63B 35/71* (2013.01); *B63B 2029/043* (2013.01)

(58) Field of Classification Search
USPC ..... 114/347
See application file for complete search history.

(56) References Cited

U.S. PATENT DOCUMENTS 5,189,974 A * 3/1993 Masters ..... B63B 1/12 114/347
5,649,498 A * 7/1997 Zigurs ..... B63B 1/121 114/347
6,035,801 A 3/2000 Addison
6,112,692 A 9/2000 Lekhtman
6,210,242 B1 4/2001 Howard et al.
6,289,838 B2 * 9/2001 Dust ..... B63B 1/042 114/292
6,745,716 B2 * 6/2004 Belyeu ..... B63B 35/71 114/347
D566,644 S * 4/2008 Houck ..... D12/302
7,461,612 B1 12/2008 Houck
D630,150 S * 1/2011 Martin ..... D12/302
8,573,146 B2 11/2013 Lee et al.
8,651,576 B2 2/2014 Farber
8,752,492 B1 * 6/2014 Harris ..... B63B 35/7926 114/61.1
8,869,731 B2 10/2014 Dow et al.
9,199,702 B2 12/2015 Cregier et al.
9,242,703 B2 1/2016 Nutz et al.
2001/0001941 A1 * 5/2001 Dust ..... B63B 1/042 114/347
2004/0112266 A1 * 6/2004 Rosen ..... B63B 1/121 114/61.1
2006/0032425 A1 * 2/2006 Hall ..... B63B 7/08 114/347
2009/0038526 A1 2/2009 Walton
2011/0114007 A1 5/2011 Flemons, III
2012/0017821 A1 1/2012 McDonough
2016/0001853 A1 1/2016 Khieowan et al.
2016/0023726 A1 1/2016 Ketterman et al.
2017/0106951 A1 * 4/2017 Murphy ..... B63B 35/71

FOREIGN PATENT DOCUMENTS

WO 03/024777 3/2003
WO 2015/196211 12/2015

OTHER PUBLICATIONS

Best Fishing Kayak Ultimate Buyers Guide 2016, http://www.kayakerguide.com/best-fishing-kayak, 8 pages.
[No Author Listed], Jackson Kayak, Big Rig Kayak Product Features, May 18, 2016; http://jacksonkayak.com/blog/kayak/big-rig/; 4 pages.
[No Author Listed], Kayak Boats—Buy the Best Kayaks, Feb. 6, 2016; http://www.kayak-boats.com/, 27 pages.
Examiner's Report dated Jun. 14, 2017 in connection with Canadian Patent No. 2.934,821—4 pages.
Notice of Allowance dated Aug. 4, 2017 in connection with Canadian Patent Application No. 2,934,821—1 page.

* cited by examiner

FISHING KAYAK

FIELD OF THE INVENTION

The invention relates generally to watercraft used for fishing, and more particularly, to fishing kayaks.

BACKGROUND

Recreational fishing has recently been gaining in popularity. For those looking to adopt this activity, one of the hurdles is the cost associated with purchasing the equipment and, in particular, with purchasing a watercraft that will be used to practice this hobby. Typically fishing boats, even small entry level jon boats, have list prices well above the 1000 USD mark.

In recent years, kayak manufacturers have been modifying their existing recreational kayaks to accommodate users desirous of using their recreational kayaks as watercraft for fishing. One approach has been to provide recreational kayaks equipped with various accessories to render the fishing experience more pleasant by including, for example, fishing rod holders, providing a place to hold a cooler and/or hooks and bait, providing more suitable seating and the likes. Recreational kayaks equipped for fishing in this manner typically have a lower price point than would typically be associated with an equally equipped conventional fishing boat, thereby making them an interesting alternative for the budget conscious user.

While such an approach is not without some interest, the requirements for watercraft used for fishing differ somewhat from those of conventional recreational kayaks.

In designing recreational kayaks, there is often a trade-off that is made between performance and stability. Thus recreational kayaks are often designed with the objective of providing maximal performance (e.g., manoeuvrability, speed, directional stability (a.k.a. tracking) etc.), providing good stability or providing a balance between the two. Generally, once some experience has been acquired, the typical recreational kayak user can be comfortable foregoing a certain amount of stability for an improved performance. It is noted that in the context of a recreational kayak, the type of movement performed by the user is generally limited to paddling. The user also often sits on a seat whose bottom is located at a level below the surface of the water, resulting in a lower center of gravity and thus greater inherent stability. Moreover, except when embarking or dismounting, the typical user remains seated throughout use. As such, the manner in which recreational kayaks are used, and the position of the user within the kayak during use, typically make it easier to reduce the amount of stability in favor of improved performance without significantly adversely impacting the user's experience.

Conversely, in watercraft used for fishing, the user often performs movements other than paddling, such as, for example, throwing out a fishing line and pulling in a fish once one has bitten. In some cases, such movements may require the user to stand atop the watercraft and therefore it cannot be assumed that the user will remain seated throughout use except when embarking or dismounting. In addition, the user may wish to visually detect the presence of fish around the watercraft thereby making it desirable to have a seat whose bottom is located at a level above the surface of the water. While having a higher seating position may afford improved visibility of the water surrounding the watercraft, it results in a higher center of gravity. Thus, as illustrated above, the manner in which a fishing kayak is used increases the stability requirements of this type of watercraft. In addition, and at the risk of over-generalizing, the average user engaged in fishing tends to be older and somewhat heavier than the average user of recreational kayaks, which adds to the need for greater stability.

However stability is not the only requirement for providing a suitable fishing kayak.

For example, besides greater stability, it may also be desirable for the fishing kayak to be silent in its displacements since generating excessive noise may scare fish away from a neighboring region of the fishing kayak. Obviously, issues pertaining to noise are essentially inexistent for typical recreational kayaks.

Moreover, since the user of the fishing kayak may want to take his kayak further out into a body of water in order to find a suitable fishing spot, it is desirable for the fishing kayak to be not only stable but to also be fast and easy to navigate in order to provide a more pleasing user experience. However, conventional highly stable recreational kayaks often do not provide suitable performance in terms of speed and/or ease of navigation. While rudders can be added to kayaks to improve the navigation, the cost associated to such devices makes this a non-ideal solution in some cases.

Consequently, there is a need in the industry to provide a fishing kayak that alleviates at least some of the deficiencies associates with existing fishing kayaks.

SUMMARY

"In accordance with a first aspect, a fishing kayak is provided comprising a body having a bow end and a stern end, the body comprising a deck and a hull. The deck defines a top side of the body of the fishing kayak and a seat is disposed atop the deck. The hull defines a bottom side of the body of the fishing kayak. The hull comprises a pontoon hull portion extending from the stern end of the body to a first intermediate position along a longitudinal axis of the body, the pontoon hull portion being comprised of two pontoon members positioned in an opposing relationship and spaced apart by a concave recess to form a tunnel structure. The hull also comprises a convex hull portion extending towards the bow end of the body from a second intermediate position along the longitudinal axis, wherein the second intermediate position is closer to the bow end of the body than the first intermediate position. The convex hull portion is comprised of a convex hull member positioned substantially along a longitudinal centerline of the body. The hull also comprises a transitional portion extending between the pontoon hull portion and the convex hull portion along the longitudinal axis, wherein in the transitional portion, the two pontoon members converge into the convex hull portion to form at least in part the convex hull member."

In some specific practical implementations, the two pontoon members gradually converge into the convex hull portion to form at least in part the convex hull member.

In some specific practical implementations, the concave recess forming the tunnel structure includes a recessed surface positioned between opposing walls of the two pontoon members.

In some specific practical implementations, in the transitional portion of the hull, a portion of the recessed surface forms a ramp that slopes downwardly to converge with the convex hull member.

It is to be appreciated that lengths of the pontoon hull portion, convex hull portion and transitional portion relative to an overall length of the hull measured along the longitudinal axis may vary between specific practical implementations. The use of different relative lengths may provide different performance effects in terms of stability, noise level, manoeuvrability, directional stability and speed.

In some very specific practical implementations, the pontoon hull portion extends between about 35% and about 45% of a length of the hull measured along the longitudinal axis, the transitional portion extends between about 35% and about 45% of the length of the hull measured along the longitudinal axis, and the convex hull portion extends over between about 10% and about 30% of the length of the hull measured along the longitudinal axis. It is however to be appreciated that other proportions may be used in some alternative implementations.

In specific practical implementations, the two pontoon members have inner facing walls and outer facing walls and respective specific parts of the outer facing walls of the pontoon members may have a tapered shape. In some specific practical implementations, the respective parts of the outer facing walls of the pontoon members having a tapered shape are located towards the stern end of the body of the fishing kayak. The tapered shape of the pontoons' outer facing walls may assist in improving directional stability (a.k.a. tracking) of the fishing kayak by helping the fishing kayak glide in a straighter manner when being displaced forwardly.

Turning now to the convex hull portion, it is to be appreciated that different shapes for the hull may be contemplated in different implementations. For examples, the convex hull portion may be an essentially U-shaped portion, a V-shaped portion, a rounded hull portion or a flat hull portion in different implementations. The U-shaped portion or the V-shaped portion may be preferred as in some implementations they have been found to provide improved displacement and speed capabilities.

In some specific practical implementations, the bow end of the fishing kayak may be configured differently from that of the bow end of recreational kayaks. In some specific practical implementations, the body of the fishing kayak has a tip wherein two axes tangential to the tip of the bow end form an angle within which the tip lies and wherein the angle within which the tip lies is an obtuse angle. The obtuse angle may vary in size between different implementations. In some specific implementation, the angle may be between about 100 degrees and about 160 degrees, between about 110 degrees and about 150 degrees, or between about 120 degrees and about 140 degrees.

In some specific practical implementations, the seat disposed atop the deck includes a seat bottom and a backrest, and the seat is adjustable between an upper and a lower position. In accordance with a specific practical implementation, the deck of the body of the fishing kayak has a surrounding edge and the seat bottom lies at least in part at a level above the surrounding edge of the deck when the seat bottom is adjusted in the upper position.

In some specific practical implementations, the stern end of the fishing kayak may be configured differently from that of the stern end of traditional recreational kayaks. In a specific practical implementation, rather than the stern end of the fishing kayak ending in a tip, the stern end is configured to have a wider edge with a substantially truncated appearance relative to that of traditional recreational kayaks. In accordance with very specific practical implementations, a ratio of a width of an edge of the stern end of the body over a maximal width of the body is at least 0.7. In some other very specific practical implementations, a ratio of a width of an edge of the stern end of the body over a maximal width of the body is at least 0.8.

In some specific practical implementations, the fishing kayak may be configured for a single user by providing a single seat on the top side of the body. In some other specific practical implementations, the fishing kayak may be configured as a tandem fishing kayak by providing two seats on the top side of the body. The configuration for a tandem fishing kayak will not be described in detail in the present document as modifications for accommodating two users on the top side of the body will become readily apparent to the person skilled in the art.

In accordance with a second aspect, a fishing kayak is provided comprising a body having a bow end and a stern end, the body comprising a deck and a hull. The deck defines a top side of the body of the fishing kayak. The hull defines a bottom side of the body of the fishing kayak. The hull comprises a pontoon hull portion extending from the stern end of the body along a longitudinal axis of the body. The pontoon hull portion is comprised of two pontoon members positioned in an opposing relationship. The pontoon hull portion defines a concave recess to form a tunnel structure. The hull also comprises a convex hull portion extending from the bow end of the body along the longitudinal axis, the convex hull portion being comprised of a convex hull member. The two pontoon members converge into the convex hull portion to form at least in part the convex hull member.

All features of embodiments which are described in this disclosure and are not mutually exclusive can be combined with one another. Elements of one embodiment can be utilized in the other embodiments without further mention.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

Figure 1:
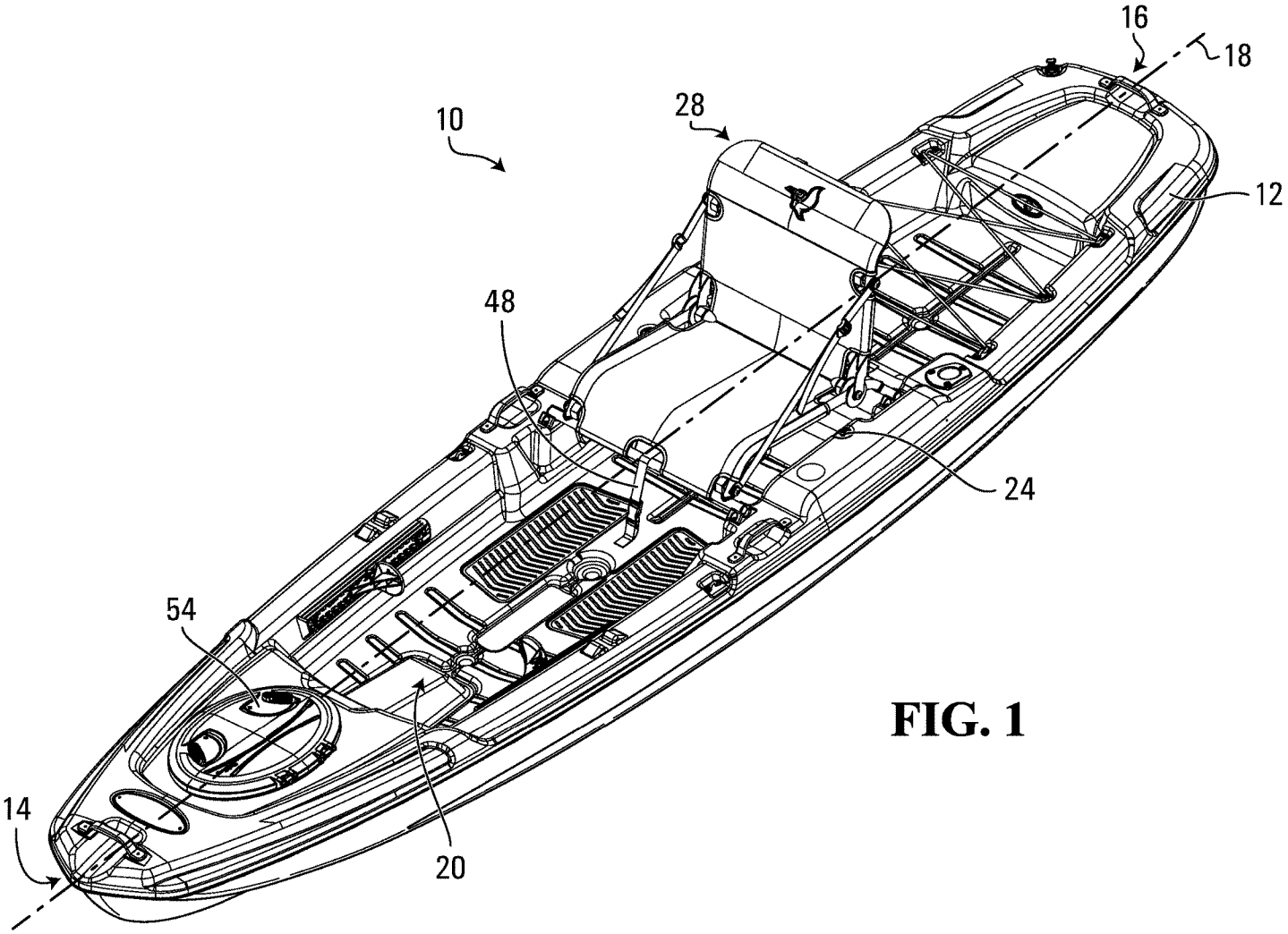
FIG. 1 is a perspective view of a fishing kayak in accordance with an embodiment of the invention.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION

Figure 2:
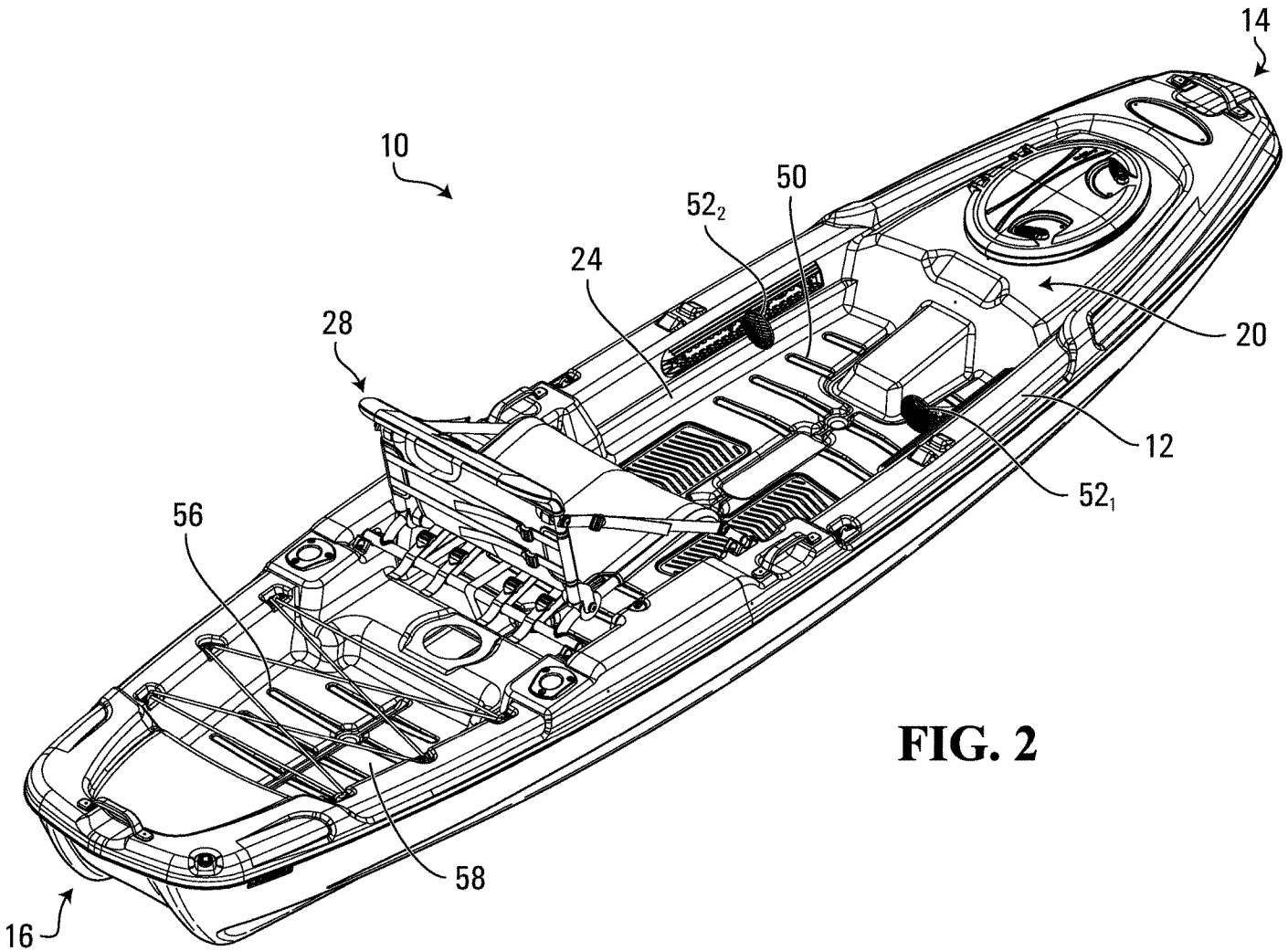
FIG. 2 is another perspective view of the fishing kayak of FIG. 1.

FIGS. 1 and 2 show an example of a fishing kayak 10 in accordance with an embodiment of the invention. The fishing kayak 10 comprises a body 12 having a bow end 14 and a stern end 16 opposite the bow end 14. More specifically, the body 12 extends along a longitudinal axis 18 from the bow end 14 to the stern end 16. The fishing kayak 10 has a longitudinal direction defined by the longitudinal axis 18, a widthwise direction transversal to the longitudinal axis 18, and a height direction transversal to the widthwise and longitudinal directions.

Figure 3:
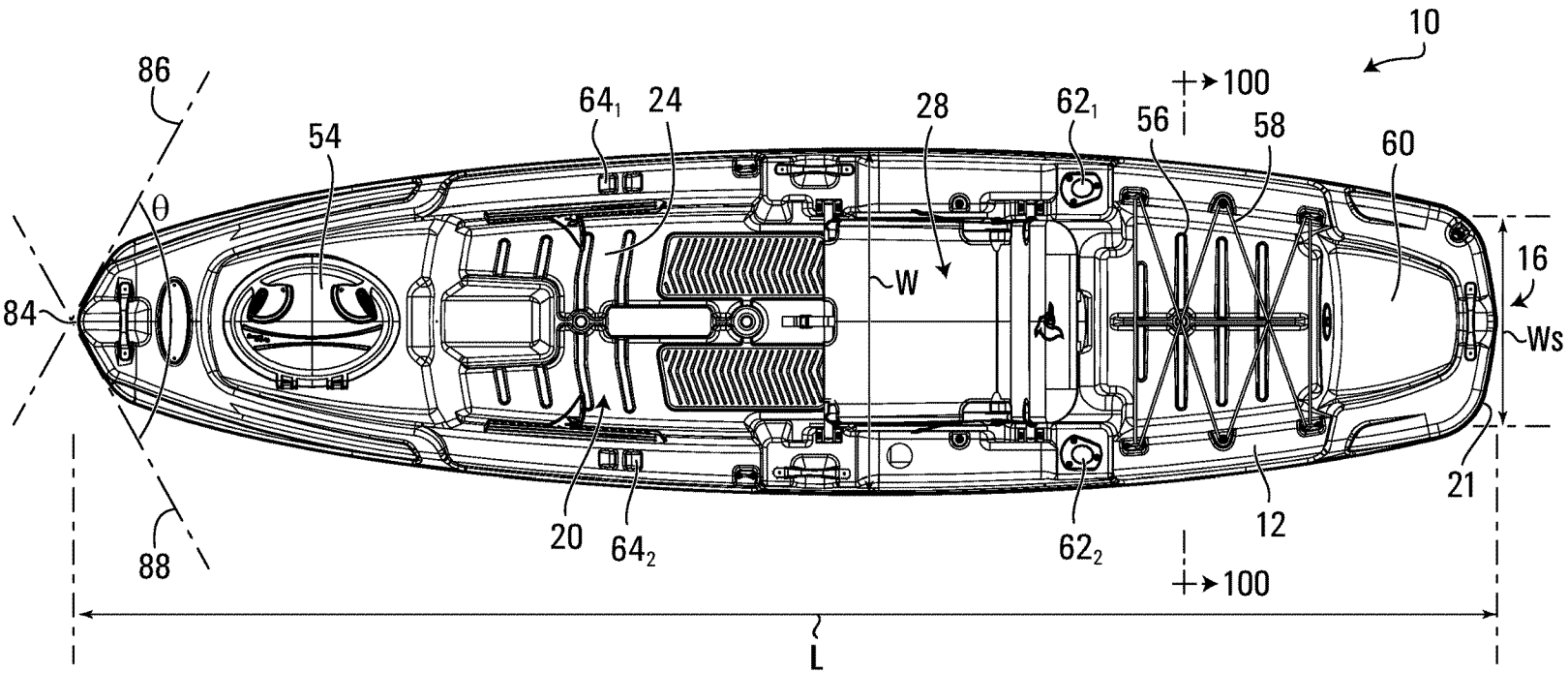
FIG. 3 is a top plan view of the fishing kayak of FIG. 1 showing a deck of a body of the fishing kayak.

As the fishing kayak 10 is primarily designed for fishing, the body 12 of the fishing kayak 10 may be made relatively wide to assist in providing increased stability to the fishing kayak 10. For instance, as shown in FIG. 3, the body 12 has a maximal width W that may be significant relative to an overall length of the fishing kayak 10. For example, in some cases, the maximal width W of the body 12 may be at least 25 inches, in some cases at least 30 inches, in some cases at least 32 inches, in some cases at least 34 inches, and in some cases even more. The maximal width W of the body 12 may be significant relative to a length L of the body 12. For instance, in some cases, a ratio of the maximal width W of the body 12 over the length L of the body 12 may be at least 0.15, in some cases at least 0.20, and in some cases at least 0.25 or more.

Moreover, the stern end 16 of the body 12 may also wide relative to the length L of the body 12, which may further assist in providing increased stability to the fishing kayak 10. For instance, an edge 21 of the stern end 16 of the body 12 may have a width $W_S$. Contrary to many conventional recreational kayaks having a stern ending in a tip, the edge 21 of the stern end is configured to have a substantially truncated appearance relative to that of traditional recreational kayaks. In some cases, a ratio of the width $W_S$ of the edge 21 of the stern end 16 over the maximal width W of the body 12 may be at least 0.7, in some cases at least 0.8, and in some cases even more. In some non-limiting implementation, the maximal width of the body 12 may in fact be at the edge 21 of the stern end 16 (effectively yielding a ratio of 1.0).

The body 12 of the fishing kayak 10 comprises a deck 20 defining a top side 24 of the body 12 and a hull 22 defining a bottom side 26 of the body 12. The deck 20 is configured to accommodate a user of the fishing kayak 10 while the hull 22 is configured to engage water on which the fishing kayak 10 travels.

The deck 20 may be provided with various features that can be useful to the user of the fishing kayak 10 and that may not necessarily be found in conventional (i.e., recreational/non-fishing) kayaks.

Figure 4:
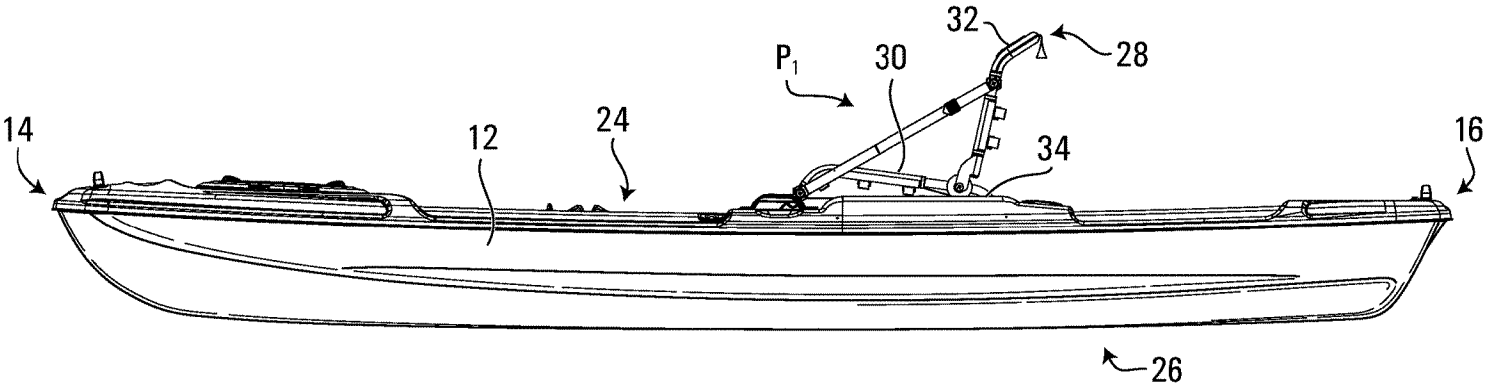
FIGS. 4 and 5 are side views of the fishing kayak of FIG. 1, in which a seat of the fishing kayak is adjusted in an upper position (FIG. 4) and a lower position (FIG. 5) respectively.
Figure 5:
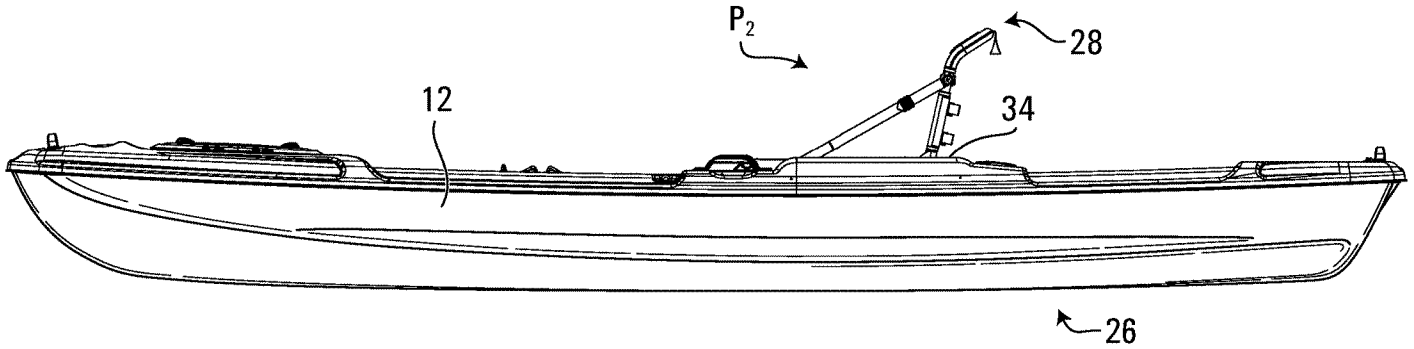
Figure 7:
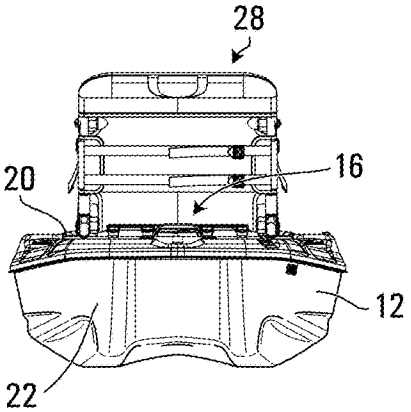
FIGS. 6 and 7 are a front elevational view and a rear elevational view of the fishing kayak of FIG. 1.

For example, in the embodiment depicted, a seat 28 is disposed atop the deck 20 for allowing a user of the fishing kayak 10 to sit in a generally upright position. The seat 28 comprises a seat bottom 30 and a backrest 32. With reference to FIGS. 4 and 5, the seat 28 may be configured to be adjustable between an upper position $P_1$ and a lower position $P_2$. For instance, as shown in FIG. 4, when the seat 28 is adjusted in the upper position $P_1$, the seat bottom 30 of the seat 28 lays at least in part at a level above a surrounding edge 34 of the deck 20. That is, in the upper position $P_1$ of the seat 28, at least a portion (e.g., a majority) of the seat bottom 30 is above the surrounding edge 34 of the deck 20 in the height direction of the fishing kayak 10. Conversely, as shown in FIG. 5, when the seat 28 is adjusted in the lower position $P_2$, the seat bottom 30 may lie below the surrounding edge 34 of the deck 20. This adjustability of the seat 28 may allow the user to elevate the seat 28 when he/she wants to have an elevated position, for example to facilitate viewing the water surrounding the fishing kayak when fishing to be able to see fish below the water surface by providing a most suitable viewing angle to the user, and to lower the seat 28 when he/she wants to have a lower position, for example to facilitate paddling.

Figure 12:
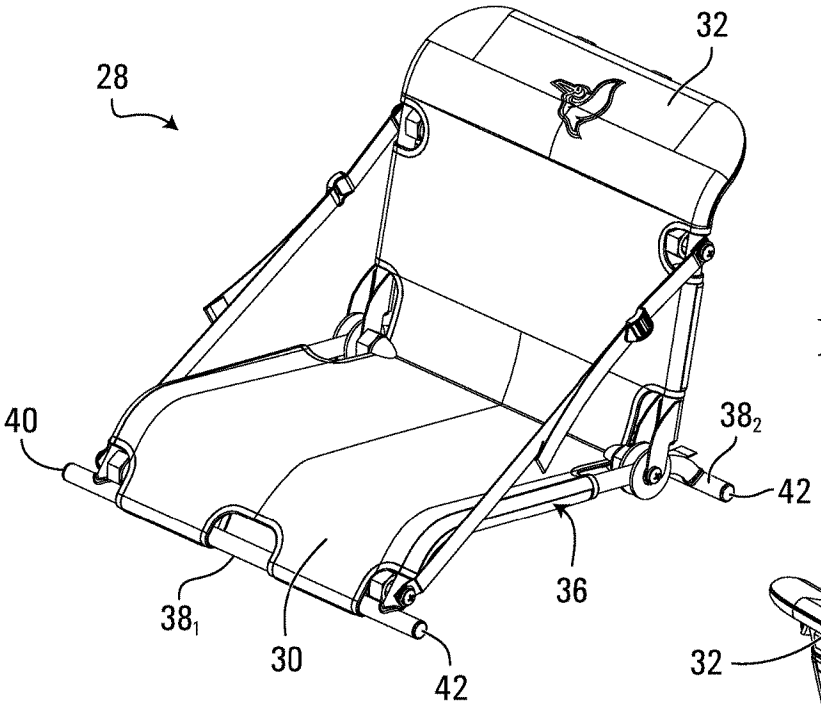
FIGS. 12 and 13 are perspective views of an adjustable seat for the fishing kayak of FIG. 1 in accordance with an embodiment of the invention.
Figure 13:
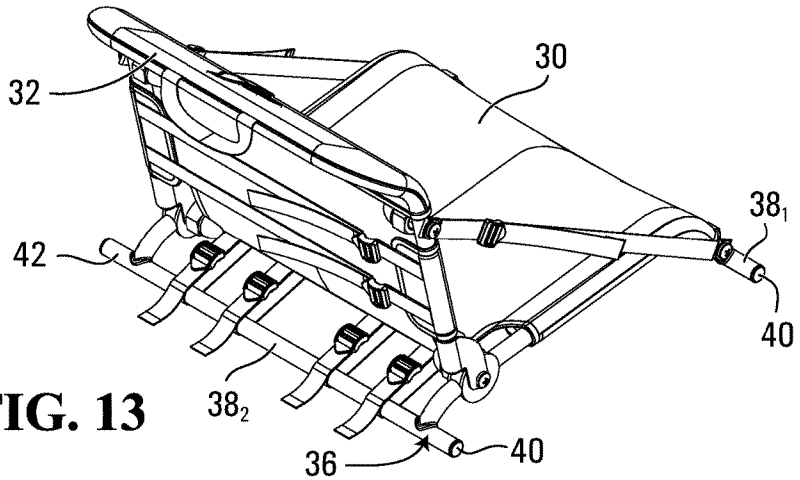
Figure 14:
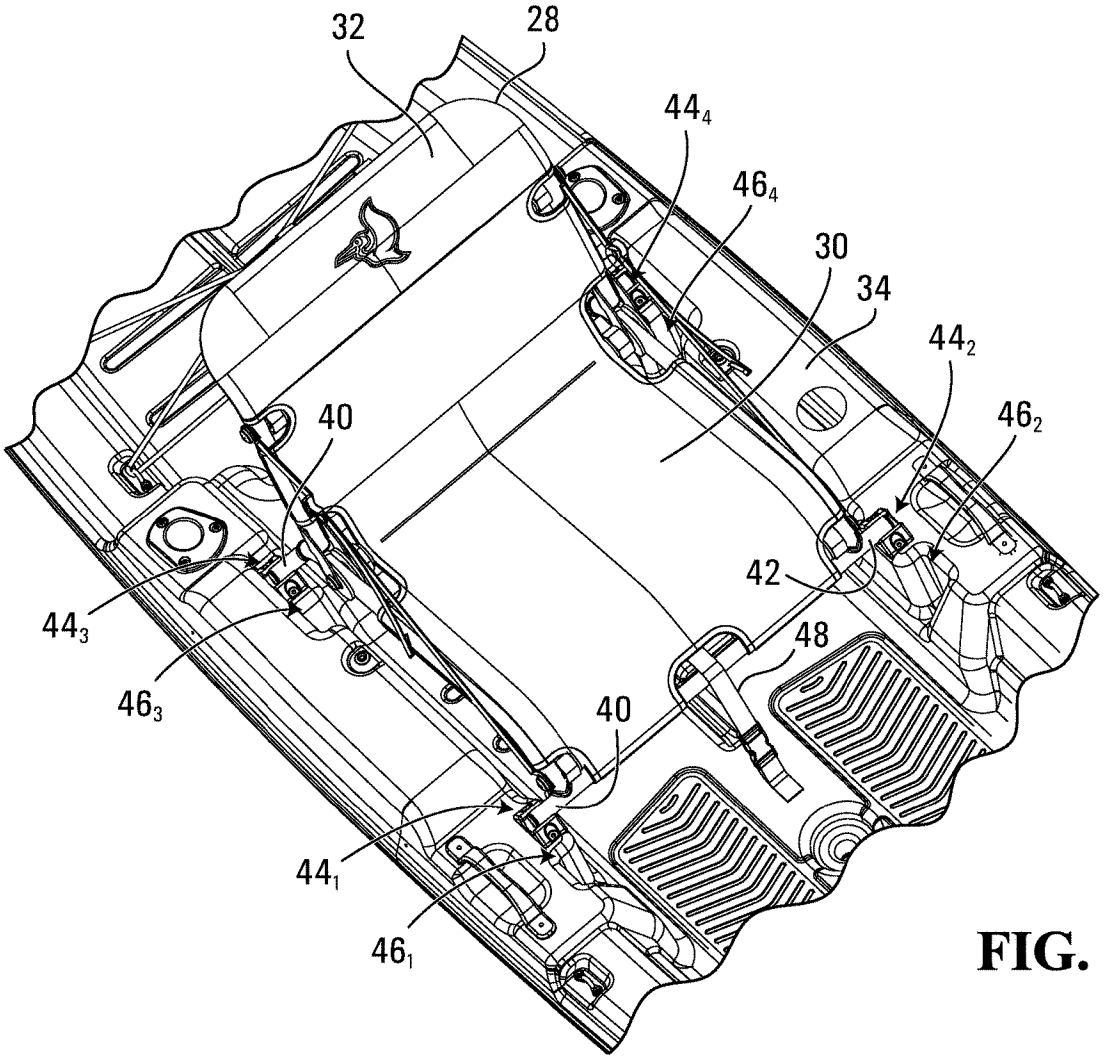
FIG. 14 is a perspective view of a portion of the fishing kayak of FIG. 1 showing a manner in which the adjustable seat of FIGS. 12 and 13 may be installed on the fishing kayak.

The adjustability of the seat 28 between the upper and lower positions $P_1$, $P_2$ may be implemented in any suitable way, many of which are known in the art of watercrafts. In the embodiment depicted, as shown in FIGS. 12 and 13, the seat 28 comprises a frame 36 including first and second transversal members $\mathbf{38}_1$, $\mathbf{38}_2$ that extend in a transversal direction of the seat 28. Each of the first and second transversal members $\mathbf{38}_1$, $\mathbf{38}_2$ comprises opposite ends 40, 42 that are configured to be received and retained in a plurality of positioning members $\mathbf{44}_1$-$\mathbf{44}_4$, $\mathbf{46}_1$-$\mathbf{46}_4$ of the deck 20. In particular, in this embodiment, as shown in FIG. 14, the positioning members $\mathbf{44}_1$-$\mathbf{44}_4$ are upper positioning members associated with the upper position $P_1$ of the seat 28 while the positioning members $\mathbf{46}_1$-$\mathbf{46}_4$ are lower positioning members associated with the lower position $P_2$ of the seat 28. That is, the upper positioning members $\mathbf{44}_1$-$\mathbf{44}_4$ define a positioning surface that is higher (in the height direction of the fishing kayak 10) than a positioning surface defined by the lower positioning members $\mathbf{46}_1$-$\mathbf{46}_4$ such that, when the opposite ends 40, 42 of the first and second transversal members $\mathbf{38}_1$, $\mathbf{38}_2$ are received in the upper positioning members $\mathbf{44}_1$-$\mathbf{44}_4$, the seat 28 is adjusted in the upper position $P_1$. Conversely, when the opposite ends 40, 42 of the first and second transversal members $\mathbf{38}_1$, $\mathbf{38}_2$ are received in the lower positioning members $\mathbf{46}_1$-$\mathbf{46}_4$, the seat 28 is adjusted in the lower position $P_2$.

In this embodiment, each of the upper positioning members $\mathbf{44}_1$-$\mathbf{44}_4$ consists of a mount that is fastened to the deck 20 and that is configured to receive either of the ends 40, 42 of the transversal members $\mathbf{38}_1$, $\mathbf{38}_2$. For example, each upper positioning member $\mathbf{44}_i$ may define a space in which the end 40 or 42 of a transversal member $\mathbf{38}_i$ may be received and retained. Moreover, in this embodiment, each of the lower positioning members $\mathbf{46}_1$-$\mathbf{46}_4$ constitutes a slot-type structure that is formed in the deck 20. For example, each of the lower positioning members $\mathbf{46}_1$-$\mathbf{46}_4$ may be formed (e.g., molded) in the deck 20 during manufacturing of the fishing kayak 10.

Furthermore, in this embodiment, both the upper and lower positioning members $\mathbf{44}_1$-$\mathbf{44}_4$, $\mathbf{46}_1$-$\mathbf{46}_4$ are configured such that the ends 40, 42 of the transversal members $\mathbf{38}_1$, $\mathbf{38}_2$ can only be inserted and removed from the upper and lower positioning members $\mathbf{44}_1$-$\mathbf{44}_4$, $\mathbf{46}_1$-$\mathbf{46}_4$ by displacing the seat 28 vertically (i.e., in the height direction of the fishing kayak 10). As such, the upper and lower positioning members $\mathbf{44}_1$-$\mathbf{44}_4$, $\mathbf{46}_1$-$\mathbf{46}_4$ preclude the transversal members $\mathbf{38}_1$, $\mathbf{38}_2$ from moving in the longitudinal and widthwise directions of the fishing kayak 10. Once the seat 28 is adjusted to its desired position, the seat 28 can be precluded from moving in the height direction of the fishing kayak 10 via a strap 48 which is secured to the deck 20 and which is configured to engage the transversal members $\mathbf{38}_1$, $\mathbf{38}_2$ of the frame 36 of the seat 28.

The deck 20 also comprises a leg area 50 located forwardly of the seat 28 for supporting the user's legs and feet. In this embodiment, the leg area 50 comprises a pair of foot support members $\mathbf{52}_1$, $\mathbf{52}_2$ for supporting respective ones of the user's feet. The foot support members $\mathbf{52}_1$, $\mathbf{52}_2$ may be adjustable such as to accommodate different leg lengths. The leg area 50 may also be used for the user to stand while fishing.

The fishing kayak 10 may be thought of as a "sit-on-top" (SOT) kayak since the user sits on top of the fishing kayak 10, in a depression of the deck 20 defined by the leg area 50 and an area of the deck 20 on which the seat 28 is positioned. This is as opposed to a "sit-inside" (SIS) kayak in which the user's legs would be enclosed within the kayak. Moreover, in this specific embodiment, the fishing kayak 10 is a single user fishing kayak. That is, the fishing kayak 10 is designed to accommodate a single user as opposed to two or more users.

In this embodiment, the deck 20 also comprises a covered storage compartment 54 adjacent the bow end 14 of the body 12 and an open storage compartment 56 adjacent the stern end 16 of the body 12. This may be useful to store equipment and, in the case of the covered storage compartment 54, to protect such equipment from exposure to water. The open storage compartment 56 may comprise securing cords 58 (such as for example bungee cords) to secure equipment in the open storage compartment 56. As an example, a cooler or other equipment and/or provisions useful for fishing may be secured in the open storage compartment 56. Optionally, the deck 20 may comprise an additional covered storage compartment at a rearmost portion 60 of the deck 20 (while the portion 60 is shown in FIG. 3, a compartment is not shown in that space in the present embodiment).

In some variants of the fishing kayak 10 (nor shown in the Figures), the rearmost portion 60 of the deck 20 may be configured with a motor mount to receive a motor module driving a propeller for the kayak 10. In a non-limiting implementation, any suitable portable watercraft or kayak motor may be used to drive the fishing kayak. In this manner, the space of the rearmost portion 60 may be equipped with a motor mount configured to allow a user to releasably fasten a motor module driving a propeller to the fishing kayak 10 to allow for greater displacements of the fishing kayak. In such embodiments, the motor mount may include one or more fasteners (not shown) located in the rearmost portion 60 in order to facilitate the user attaching and detaching the motor. The specific configuration of the motor mount may vary between implementations as will be appreciated by the person skilled in the art and is not critical to the present invention and will thus not be described in further detail here.

Furthermore, in the embodiment depicted, the deck 20 comprises a plurality of pole holders $\mathbf{62}_1$, $\mathbf{62}_2$ for holding fishing poles. For example, each of the pole holders $\mathbf{62}_1$, $\mathbf{62}_2$ may be comprised of a recess in the deck 20 that is sufficiently deep to securely hold a fishing pole. The deck 20 also comprises a pair of paddle holders $\mathbf{64}_1$, $\mathbf{64}_2$ at opposite sides of the fishing kayak 10 and aligned with one another to securely hold a paddle in a direction generally transverse to the longitudinal axis 18 of the fishing kayak in order to allow the user to securely position his/her paddle while fishing. In the example depicted, the pair of paddle holders $\mathbf{64}_1$, $\mathbf{64}_2$ is comprised of clips configured for resiliently engaging the shaft of a paddle. The pair of paddle holders $\mathbf{64}_1$, $\mathbf{64}_2$ are positioned in the front third of the fishing kayak, toward the bow end 14 of the fishing kayak 10 and forwardly positioned at a distance from the seat 28. As a result of such positioning, when a paddle is engaged within the paddle holders $\mathbf{64}_1$, $\mathbf{64}_2$, space for the user's legs is provided without being significantly hindered by the transversely positioned paddle to provide accrued mobility to the user of the fishing kayak while securing the paddle.

Figure 8:
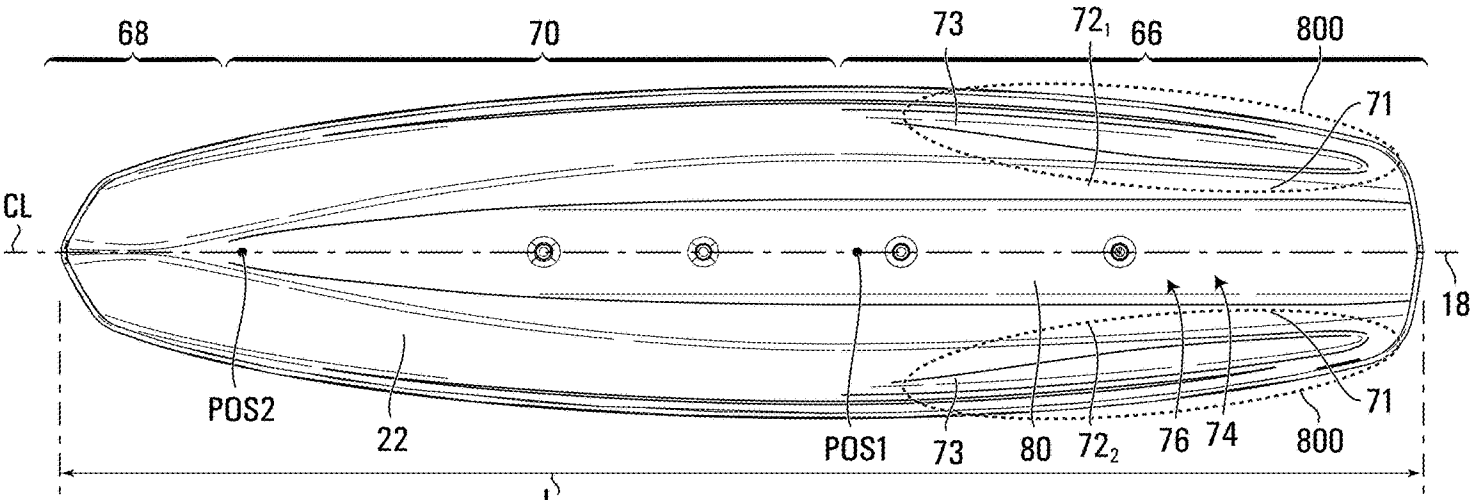
FIG. 8 is a bottom plan view of the fishing kayak of FIG. 1 showing a hull of the body of the fishing kayak.

The hull 22 of the body 12 is configured to impart stability to the fishing kayak 10 while concurrently maintaining relatively efficient maneuverability and quiet displacement for the fishing kayak 10. As will be explained in more detail below with reference to FIG. 8, in the embodiment depicted, the hull 22 comprises a pontoon hull portion 66, a convex hull portion 68 and a transitional portion 70 which collaborate to provide these advantageous characteristics to the fishing kayak 10.

The pontoon hull portion 66 of the hull 22 extends from the stern end 16 of the body 12 to a first intermediate position POS1 along the longitudinal axis 18 of the body 12. The pontoon hull portion 66 comprises a pair of pontoon members $\mathbf{72}_1$, $\mathbf{72}_2$ positioned in an opposing relationship. More specifically, the pontoon members $\mathbf{72}_1$, $\mathbf{72}_2$ are positioned on either side of a longitudinal centerline CL of the body 12 of the fishing kayak 10 (i.e., a centerline coincident with the longitudinal axis 18 of the body 12 depicted in FIG. 8). Each one of the pontoon members $\mathbf{72}_1$, $\mathbf{72}_2$ comprises an inner facing wall 71 facing the longitudinal centerline CL of the body 12 and an outer facing wall 73 opposite the inner facing wall 71 (i.e., facing away from the longitudinal centerline CL of the body 12). As such, the inner facing walls 71 of the pontoon members $\mathbf{72}_1$, $\mathbf{72}_2$ may be considered as "opposing walls". The pontoon members $\mathbf{72}_1$, $\mathbf{72}_2$ are spaced apart in the widthwise direction of the fishing kayak 10 by a concave recess 74 which forms a tunnel structure 76. In the embodiment depicted, the concave recess 74 of the pontoon hull portion 66 includes a recessed surface 80 that is generally flat and defines an upper surface of the tunnel structure 76. More specifically, the recessed surface 80 is positioned between the respective inner facing walls 71 of the pontoon members $\mathbf{72}_1$, $\mathbf{72}_2$.

Furthermore, in this embodiment, at least parts 800 of the outer facing walls 73 of the pontoon members $\mathbf{72}_1$, $\mathbf{72}_2$ have a tapered shape. That is, specific parts 800 of each of the outer facing walls 73 of the pontoon members $\mathbf{72}_1$, $\mathbf{72}_2$ have a tapered shape making the width of the pontoons in those specific parts narrower. If we look at this differently, the outer facing walls 73 are configured such that spacing between the outer facing wall 73 of a pontoon member $\mathbf{72}_i$ and the longitudinal centerline CL of the body 12 is greater closer to the first intermediate position POS1 than to the stern end 16 of the body 12. Advantageously, the tapered shape of the pontoon members $\mathbf{72}_1$, $\mathbf{72}_2$ outer facing walls 73 may in some embodiments assist in improving directional stability (tracking) of the fishing kayak by helping the fishing kayak glide in a straighter manner when being displaced forwardly. In addition, the tapered shape of the outer facing walls 73 of the pontoon members $\mathbf{72}_1$, $\mathbf{72}_2$ may help in reducing turbulence behind the pontoon members $\mathbf{72}_1$, $\mathbf{72}_2$ which may otherwise negatively affect the performance (e.g., speed) of the fishing kayak 10.

Figure 10:
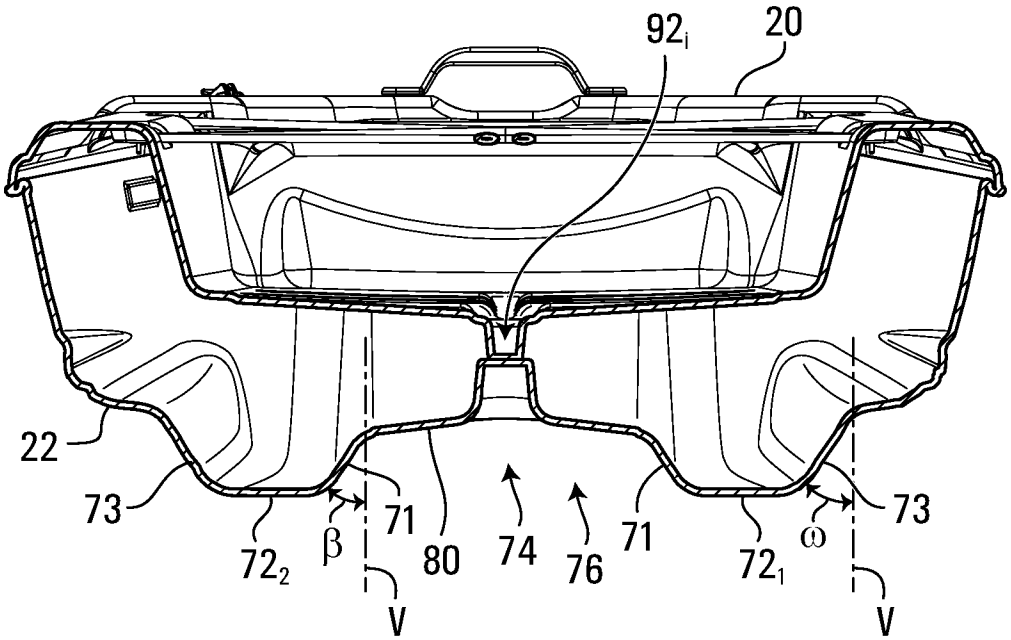
FIG. 10 shows a cross-section of the fishing kayak of FIG. 1 taken along line 100-100 of FIG. 3.

Furthermore, in the specific embodiment depicted, the outer facing wall 73 of each of the pontoon members $\mathbf{72}_1$, $\mathbf{72}_2$ is configured to have a varying inclination along a length of the outer facing wall 73. More specifically, in this example of implementation, as shown in FIG. 10, the outer facing wall 73 of the pontoon member $\mathbf{72}_i$ defines an angle $\omega$ relative to a vertical axis V extending in the height direction of the fishing kayak 10. The angle $\omega$ varies for at least a part of the length of the outer facing wall 73. For example, the angle ω may be greater at a position closer to the first intermediate position POS1 than to a position closer to the stern end 16 such that the outer facing wall is more vertical closer to the stern end 16 than to the first intermediate position POS1 or the bow end 14. For instance, in some cases, the angle ω between the outer facing wall 73 and the vertical axis V at a location adjacent to the first intermediate position POS1 may be at least 45°, in some cases at least 50°, in some cases at least 60°, in some cases at least 70°, and in some cases even more. Contrastingly, in some cases, the angle ω between the outer facing wall 73 and the vertical axis V at a location adjacent to the stern 16 may be no more than 45°, in some cases no more than 40°, in some cases no more than 30°, in some cases no more than 20°, and in some cases even less (e.g., 15° or less). The reduced inclination (i.e., increased verticality) of the outer facing wall 73 near to the stern end 16 can increase resistance to lateral displacements of the fishing kayak 10 which may assist in imparting greater directional stability (tracking) of the fishing kayak 10.

Looking now to the inner facing walls 71 of the pontoon members 72 of the specific embodiment depicted in the Figures, it is noted that these walls are configured to be substantially vertical. More specifically, as shown in FIG. 10, an angle β between the inner facing wall 71 and the vertical axis V may be relatively small. For instance, in some cases, the angle β between the inner facing wall 71 and the vertical axis V may be no more than 40°, in some cases no more than 30°, in some cases no more than 20°, and in some cases even less (e.g., 15° or less). This substantial verticality of the inner facing wall 71 of the pontoon member $\mathbf{72}_i$ may help the inner facing wall 71 resist lateral movement of the fishing kayak 10 and moreover, channels the water in the tunnel structure 76 so that it is displaced substantially along the longitudinal axis 18. As such, the configuration of the inner face walls 71 of the pontoon member may assist in improving directional stability (tracking) of the fishing kayak 10.

The tunnel structure 76 of the pontoon hull portion 66 may provide an enhanced stability to the fishing kayak 10. Notably, in use, rotation of the fishing kayak 10 about the longitudinal centerline CL of the body 12 may be resisted by the pontoon members $\mathbf{72}_1$, $\mathbf{72}_2$ of the tunnel structure 76. More specifically, each pontoon member $\mathbf{72}_i$ forms a buoyant volume that resists rotation about the longitudinal centerline CL of the body 12 (and thus resists being submerged in the water) due to a spacing between the inner wall 71 of the pontoon member $\mathbf{72}_i$ and the longitudinal centerline CL of the body 12.

The pontoon hull portion 66 may extend over a significant portion of a length $L_H$ of the hull 22 measured along the longitudinal axis 18. For instance, in some cases, the pontoon hull portion 66 extends over at least 10% of the length $L_H$ of the hull 22, in some cases over at least 20% of the length $L_H$ of the hull 22, in some cases over at least 30% of the length $L_H$ of the hull 22, and in some cases even more. However, the pontoon hull portion 66 extends over less than a majority of the length $L_H$ of the hull 22. That is, the pontoon hull portion 66 extends over less than 50% of the length $L_H$ of the hull 22. In preferred specific practical implementations, the pontoon hull portion 66 extends between about 35% and about 45% of the length $L_H$ of the hull 22. It is noted that, in some embodiments, the length $L_H$ of the hull 22 may correspond to the length L of the body 12 of the fishing kayak 10, such as, for example, in embodiments where the deck 20 has a same length as the length $L_H$ of the hull 22.

The convex hull portion 68 extends towards the bow end 14 of the body 12 from a second intermediate position POS2 along the longitudinal axis 18 of the body 12 that is closer to the bow end 14 of the body 12 than the first intermediate position POS1. The convex hull portion 68 comprises a convex hull member 78 having a convex shape. The convex shape of the convex hull member 78 may differ in accordance to different embodiments. In this embodiment, the convex hull member 78 is an essentially V-shaped member whereby a pointed portion 85 of the V-shaped member (i.e., a narrow portion of the V-shaped member) is pointed forwardly toward the bow end 14. In other embodiments (not shown in the Figures), the convex hull member 78 may be an essentially U-shaped member. In yet other embodiments (not shown in the Figures), the convex hull member 78 may be an essentially rounded hull member or a flat hull member.

In some cases, the convex hull portion 68 may extend over at least 5% of the length $L_H$ of the hull 22, in some cases over at least 10% of the length $L_H$ of the hull 22, in some cases over at least 20% of the length $L_H$ of the hull 22, and in some cases even more. However, the convex hull portion 68 extends over less than a majority of the length $L_H$ of the hull 22. That is, the convex hull portion 68 extends over less than 50% of the length $L_H$ of the hull 22. In preferred specific practical implementations, the convex hull portion 68 extends between about 10% and about 30% of the length $L_H$ of the hull 22.

While the pontoon hull portion 66 is designed to improve the stability of the fishing kayak 10, the convex hull portion 68 is designed to improve other performance aspects of the fishing kayak 10. In particular, the convex shape of the convex hull member 78 may allow the fishing kayak 10 to facilitate the parting of water as the fishing kayak 10 moves forwardly such as to direct the water to the left and to the right of the fishing kayak 10. This may allow the fishing kayak 10 to move faster on the water. Furthermore, in contrast with a kayak which would have a tunnel hull (i.e., a hull with a tunnel structure) that extends throughout an entire length of the kayak, the inclusion of the convex hull portion 68 and its convex hull member 78 may allow reduced noise generation when the fishing kayak 10 moves forward. This may be particularly useful to avoid or otherwise minimize chances of chasing away fish due to noise generated by displacement of the fishing kayak 10.

Figure 11:
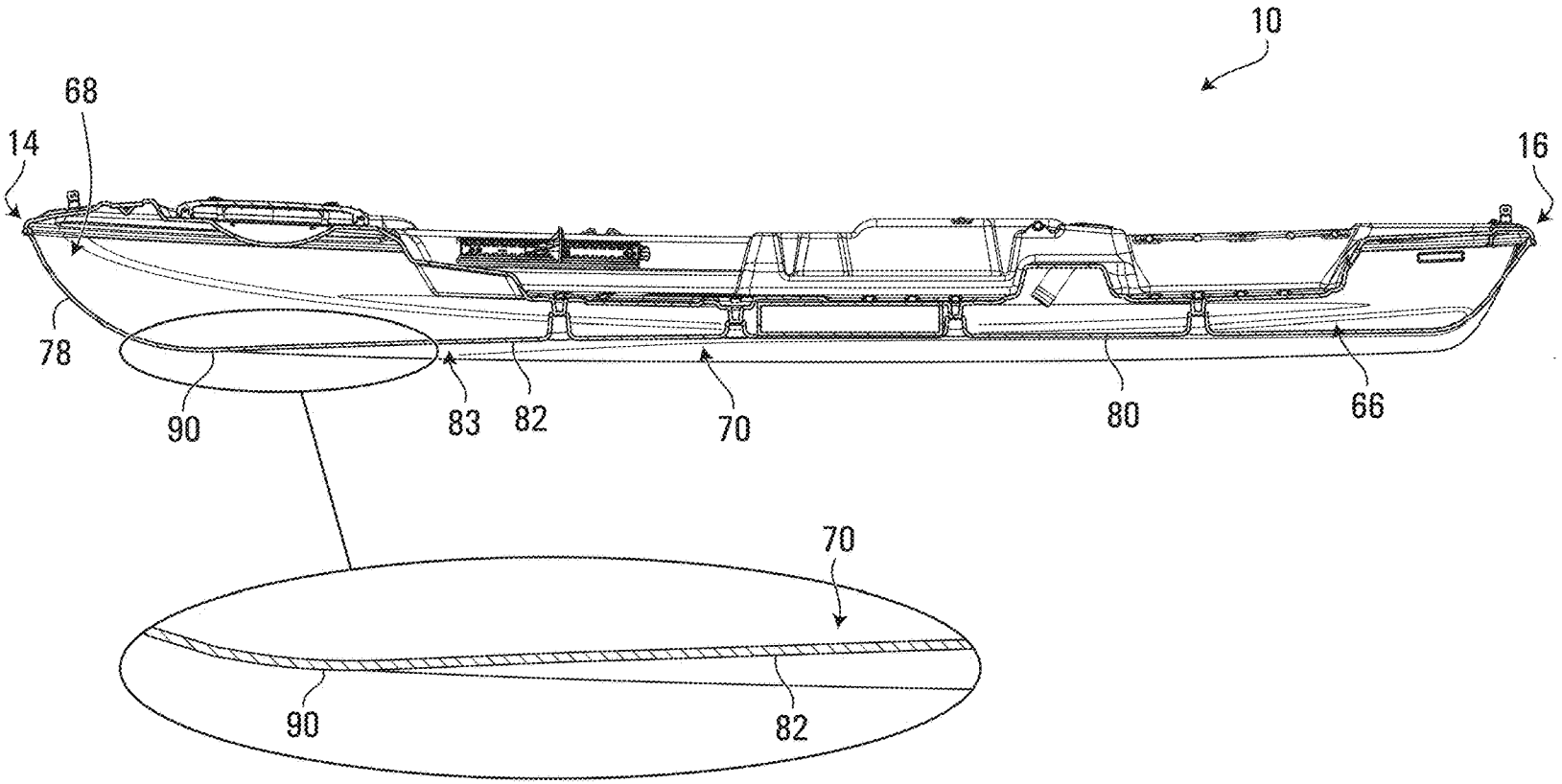
FIG. 11 shows a cross-section of the fishing kayak of FIG. 1 taken along a plane in which a longitudinal centerline of the fishing kayak lies.

The transitional portion 70 of the hull 22 extends between the pontoon hull portion 66 and the convex hull portion 68 along the longitudinal axis 18 of the body 12. In the transitional portion 70, the pontoon members $\mathbf{72}_1$, $\mathbf{72}_2$ of the pontoon hull portion 66 converge into the convex hull portion 68 to form at least in part the convex hull member 78 of the convex hull portion 68. More specifically, in the embodiment depicted in the Figures, the pontoon members $\mathbf{72}_1$, $\mathbf{72}_2$ gradually converge into the convex hull portion 68 to form at least in part the convex hull member 68. For instance, the pontoon members $\mathbf{72}_1$, $\mathbf{72}_2$ curve inwardly towards the longitudinal centerline CL of the body 12 until their inner facing walls 71 substantially merge with one another at the second intermediate position POS2. Moreover, in the transitional portion 70, a portion 82 of the recessed surface 80 forms a ramp 83 that slopes downwardly in the height direction of the fishing kayak 10 to converge with the convex hull member 78. This may be best seen in FIG. 11, which shows a cross-sectional view of the fishing kayak 10 taken along a plane in which the longitudinal centerline CL lies. As shown, the second intermediate position POS2, at which the transitional portion 70 merges with the convex hull portion 68, defines an apex 90 which constitutes a lowest point of the hull 22 in the height direction of the fishing kayak 10 along the cross-section at the longitudinal centerline CL. The apex 90 may be useful to prevent or otherwise minimize entry of air into the tunnel structure 76 at the transitional portion 70 and pontoon hull portion 66 of the hull 22. More specifically, the low position of the apex 90 may prevent or minimize air from travelling underneath the convex hull portion 68 and infiltrate the concave recess 74.

In this embodiment, the transitional portion 70 extends over a significant portion of the length $L_H$ of the hull 22. For instance, in some cases, the transitional portion 70 may extend over at least 5% of the length $L_H$ of the hull 22, in some cases over at least 10% of the length $L_H$ of the hull 22, in some cases over at least 20% of the length $L_H$ of the hull 22, in some cases over at least 30% of the length $L_H$ of the hull 22, in some cases over at least 40% of the length $L_H$ of the hull 22, in some cases over at least 50% of the length $L_H$ of the hull 22, and in some cases even more. In preferred specific practical implementations of the type shown in the Figures, the transitional portion 70 extends between about 35% and about 45% of the length $L_H$ of the hull 22.

The combination of a pontoon hull portion and convex hull portion shown in the embodiments depicted in the Figures may assist in imparting stability to the fishing kayak 10 while concurrently providing relatively efficient directional stability (tracking) and quiet displacement for the fishing kayak 10.

Figure 6:
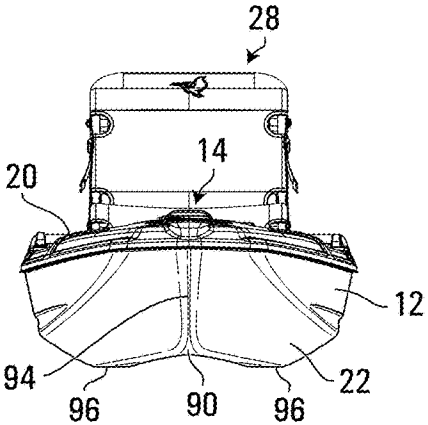

Furthermore, as shown in the embodiment depicted in the Figures, the fishing kayak 10 may be configured to seamlessly merge the convex hull portion 68 with the two pontoon members $\mathbf{72}_1$, $\mathbf{72}_2$ of the pontoon hull portion 66 that extend into the transitional portion 70. More specifically, in this embodiment, the convex hull member 78 of the convex hull portion 68 comprises a ridge 94 that is disposed generally centrally of the fishing kayak 10 (i.e., substantially aligned with the longitudinal centerline CL of the body 12). The ridge 94 comprises the apex 90 which constitutes a lowest point of the convex hull member 78 in the height direction of the fishing kayak 10. At the transitional portion 70, the ridge 94 of the convex hull member 78 diverges to form a respective ridge 96 of each of the two pontoon members $\mathbf{72}_1$, $\mathbf{72}_2$. As shown in FIG. 6, the apex 90 is substantially level with the ridge 96 of each of the two pontoon members $\mathbf{72}_1$, $\mathbf{72}_2$ in the height direction of the fishing kayak 10 (i.e., substantially at the same height). This may result in a more seamless transition between the convex hull portion 66 and the pontoon hull portion 68 which may improve the performance of the fishing kayak 10. For example, in some cases, this may lessen the resistance of the fishing kayak 10 to gliding on the water thus improving the speed of the fishing kayak 10.

Figure 9:
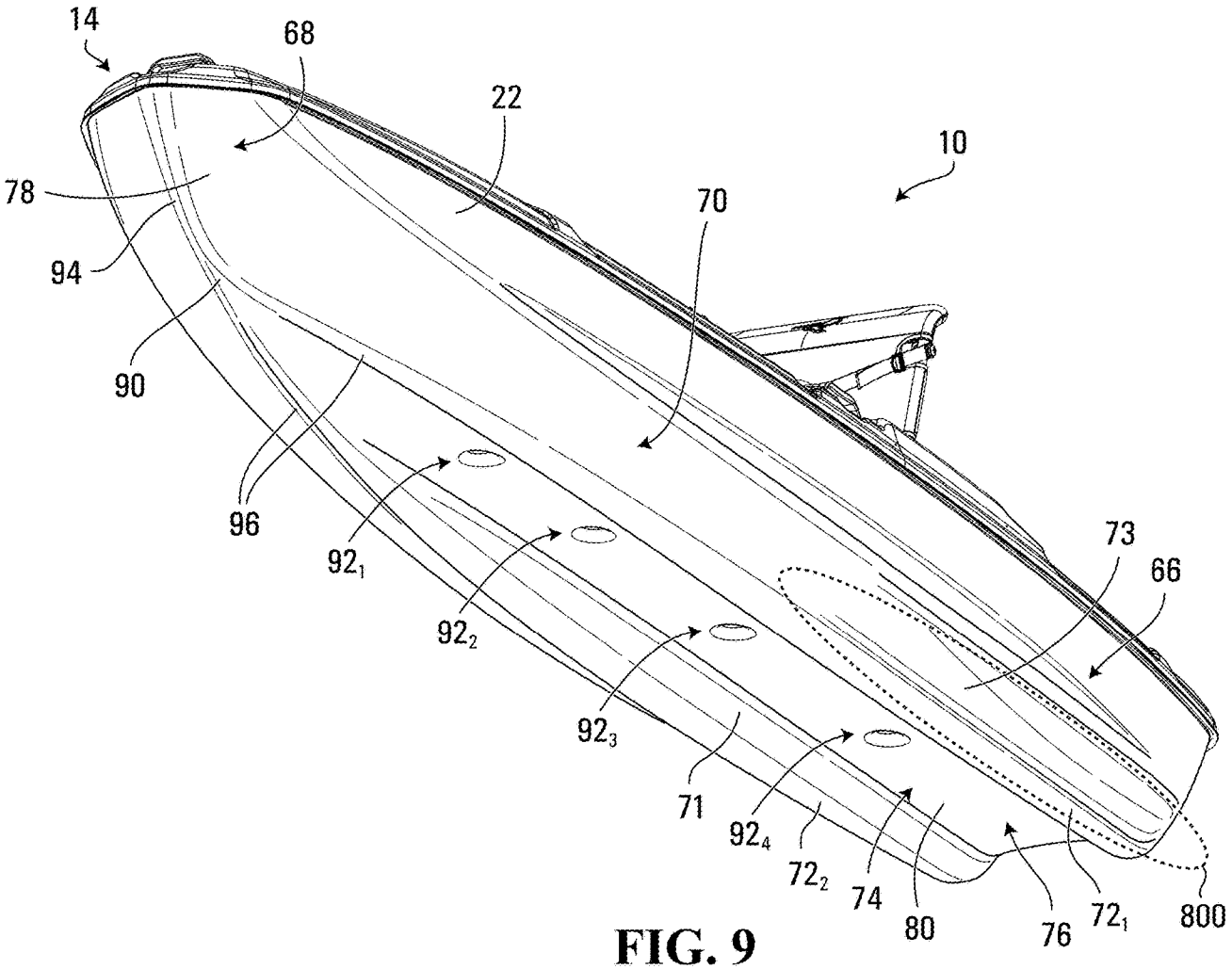
FIG. 9 is a bottom perspective view of the fishing kayak of FIG. 1.

With reference to FIGS. 9 and 10, the body 12 of the fishing kayak 10 is also shown as comprising a plurality of drainage holes $\mathbf{92}_1$-$\mathbf{92}_4$ through which water from the deck 20 may travel to the bottom (hull) side 26 of the body 12 and into a body of water on which the fishing kayak 10 travels. In this example of implementation, the drainage holes $\mathbf{92}_1$-$\mathbf{92}_4$ open up into the tunnel structure 76 of the hull 22 such as to traverse a smallest distance from the top side 24 to the bottom side 26 of the body 12. It is to be appreciated that while the Figures show four (4) drainage holes $\mathbf{92}_1$-$\mathbf{92}_4$ positioned essentially equidistant to another generally along the center line CL of the kayak, it is to be appreciated that other embodiments may additional or fewer drainage holes and that such drainage hole may be otherwise positioned either along the center line or elsewhere in the body of the kayak to provide for suitable drainage of the top side of the kayak.

Furthermore, in this embodiment, with reference to FIG. 3, the bow end 14 of the body 12 may also be configured to enhance the stability of the fishing kayak 10. For instance, in this example of implementation, the bow end 14 of the body 12 may have a relatively obtuse (i.e., blunt) shape. More specifically, the bow end 14 comprises a tip 84 defined by an angle θ formed between a pair of axes 86, 88 tangential to the tip 84 and within which the tip 84 lies. The angle θ is an obtuse angle (i.e., an angle exceeding 90° but less than 180°). For instance, in some cases the angle θ may be between about 100° and about 160°, in some cases between about 110° and about 150°, and in some cases between about 120° and about 140°. In the specific non-limiting example depicted in the Figures, the angle θ is an angle of 120°.

The relatively obtuse shape of the bow end 14 of the body 12 may cause the bow end 14 to provide more resistance to rotation about the centerline CL of the body 12 and thus may improve the stability of the fishing kayak 10. Moreover, as the user of the fishing kayak 10 may be relatively inexperienced in handling a kayak, the user may be wary of the pointed shape of the bow end of conventional kayaks which he/she may associate with relatively unstable watercrafts. As such, the relatively obtuse shape of the bow end 14 of the fishing kayak 10 may inspire more confidence in the user of the fishing kayak 10, especially since this relatively obtuse shape of the bow end 14 may be familiar for the user since "jon boats", which are typically used by fishing enthusiasts, generally have a visually similar obtuse bow end.

Fishing kayaks of the type depicted in FIGS. 1 to 11 may be manufactured using any suitable process, including without being limited to, thermoforming processes, blowmolding processes and rotomolding process. In a specific practical implementation, fishing kayaks of the type depicted in FIGS. 1 to 11 may be manufactured by molding two sheets of extrudable material using a thermoforming process to shape the two manufactured sheets into a kayak shape of the type described in the present document, one sheet being used for the top side and the other for the bottom side of the kayak.

In addition, while the specific embodiment described in the present document pertains to a fishing kayak configured for a single user by providing a single seat on the top side of the body, alternatives are possible. For example, in some alternative practical implementations, the fishing kayak may be configured as a tandem fishing kayak by providing two seats on the top side of the body. The configuration for a tandem fishing kayak will not be described in detail in the present document as modifications for accommodating two users on the top side of the body will become readily apparent to the person skilled in the art.

The foregoing is considered as illustrative only of the principles of the invention. Since numerous modifications and changes will become readily apparent to those skilled in the art in light of the present description, it is not desired to limit the invention to the exact examples and embodiments shown and described, and accordingly, suitable modifications and equivalents may be resorted to. It will be understood by those of skill in the art that throughout the present specification, the term "a" used before a term encompasses embodiments containing one or more to what the term refers. It will also be understood by those of skill in the art that throughout the present specification, the term "comprising", which is synonymous with "including," "containing,"

or "characterized by," is inclusive or open-ended and does not exclude additional, un-recited elements or method steps.

Unless otherwise defined, all technical and scientific terms used herein have the same meaning as commonly understood by one of ordinary skill in the art to which this invention pertains. In the case of conflict, the present document, including definitions will control.

Although the present invention has been described in considerable detail with reference to certain embodiments thereof, variations and refinements are possible and will become apparent to the person skilled in the art in view of the present description. The invention is defined more particularly by the attached claims.

The invention claimed is:

1. A fishing kayak comprising:

a body having a bow end and a stern end, the body comprising:

a deck defining a top side of the body of the fishing kayak, wherein a seat is disposed atop the deck;

a hull defining a bottom side of the body of the fishing kayak, the hull comprising:

a pontoon hull portion extending from the stern end of the body to a first intermediate position along a longitudinal axis of the body, the pontoon hull portion being comprised of two pontoon members positioned in an opposing relationship and spaced apart by a concave recess to form a tunnel structure, wherein the concave recess forming the tunnel structure includes a recessed surface positioned between opposing walls of the two pontoon members;

a convex hull portion extending towards the bow end of the body from a second intermediate position along the longitudinal axis, wherein the second intermediate position is closer to the bow end of the body than the first intermediate position, said convex hull portion being comprised of a convex hull member positioned substantially along a longitudinal centerline of the body;

a transitional portion extending between the pontoon hull portion and the convex hull portion along the longitudinal axis, wherein in the transitional portion, the two pontoon members converge into the convex hull portion to form at least in part the convex hull member and a portion of the recessed surface positioned between opposing walls of the two pontoon members forms a ramp that slopes downwardly to converge with the convex hull member.

2. A fishing kayak as defined in claim 1, wherein the transitional portion extends over at least 20% of a length of the hull measured along the longitudinal axis.

3. A fishing kayak as defined in claim 1, wherein the convex hull portion extends over at least 10% of a length of the hull measured along the longitudinal axis.

4. A fishing kayak as defined in claim 3, wherein the convex hull portion extends over less than 50% of a length of the hull measured along the longitudinal axis.

5. A fishing kayak as defined in claim 4, wherein the pontoon hull portion extends over at least 20% of a length of the hull measured along the longitudinal axis.

6. A fishing kayak as defined in claim 5, wherein the pontoon hull portion extends over less than 50% of a length of the hull measured along the longitudinal axis.

7. A fishing kayak as defined in claim 1, wherein:

a. the pontoon hull portion extends between about 35% and about 45% of a length of the hull measured along the longitudinal axis;

b. the transitional portion extends between about 35% and about 45% of the length of the hull measured along the longitudinal axis; and c. the convex hull portion extends between about 10% and about 30% of the length of the hull measured along the longitudinal axis.

8. A fishing kayak as defined in claim 1, wherein the two pontoon members have inner facing walls and outer facing walls, wherein at least some parts of the outer facing walls of the pontoon members have a tapered shape.

9. A fishing kayak as defined in claim 8, wherein the parts of the outer facing walls of the pontoon members having the tapered shape are located towards the stern end of the body of the fishing kayak.

10. A fishing kayak as defined in claim 8, wherein an inclination of the outer facing walls of the pontoon members varies along at least part of a length of the outer facing walls.

11. A fishing kayak as defined in claim 10, wherein the inclination of the outer facing walls tends to a vertical orientation towards the stern end of the body.

12. A fishing kayak as defined in claim 11, wherein the inner facing walls tends to a vertical orientation in at least part of the pontoon portion of the hull.

13. A fishing kayak as defined in claim 1, wherein the convex hull portion is one of an essentially U-shaped portion and an essentially V-shaped portion.

14. A fishing kayak as defined in claim 1, wherein the convex hull portion is an essentially rounded hull portion.

15. A fishing kayak as defined in claim 1, wherein the bow end of the body of the fishing kayak includes a tip, wherein two axes tangential to the tip of the bow end form an angle within which the tip lies.

16. A fishing kayak as defined in claim 15, wherein the angle within which the tip lies is an obtuse angle.

17. A fishing kayak as defined in claim 16, wherein the obtuse angle is an angle between about 100 degrees and about 160 degrees.

18. A fishing kayak as defined in claim 1, wherein the seat disposed atop the deck includes a seat bottom and a backrest, wherein the seat is adjustable between an upper and a lower position.

19. A fishing kayak as defined in claim 18, wherein the deck of the body of the fishing kayak has a surrounding edge and wherein the seat bottom lays at least in part at a level above the surrounding edge of the deck when the seat is adjusted in the upper position.

20. A fishing kayak as defined in claim 1, wherein a ratio of a width of an edge of the stern end of the body over a maximal width of the body is at least 0.7.

21. A fishing kayak as defined in claim 1, wherein the convex hull member comprises a ridge that diverges to form a ridge of each of the two pontoon members.

22. A fishing kayak as defined in claim 21, wherein a lowest point of the ridge of the convex hull member is substantially level with the ridge of each of the two pontoon members in a height direction of the fishing kayak.

23. A fishing kayak as defined in claim 1, wherein the fishing kayak is a single user fishing kayak.

24. A fishing kayak comprising:

a body having a bow end and a stern end, the body comprising:

a deck defining a top side of the body of the fishing kayak;

a hull defining a bottom side of the body of the fishing kayak, the hull comprising:

a pontoon hull portion extending from the stern end of the body along a longitudinal axis of the body, the pontoon hull portion being comprised of two spaced apart pontoon members positioned in an opposing relationship along lateral sides of the hull, wherein a recessed surface is positioned between opposing walls of the two spaced apart pontoon members;

a convex hull portion extending from the bow end of the body along the longitudinal axis, said convex hull portion being comprised of a convex hull member positioned substantially along a longitudinal centerline of the body;

wherein a portion of the recessed surface positioned between opposing walls of the two spaced apart pontoon members forms a ramp that slopes downwardly to converge with the convex hull member.

25. A fishing kayak as defined in claim 24, wherein the two pontoon members gradually converge into the convex hull portion to form at least in part the convex hull member.

26. A fishing kayak as defined in claim 24, wherein:

a. the pontoon hull portion extends between about 35% and about 45% of a length of the hull measured along the longitudinal axis; and b. the convex hull portion extends between about 10% and about 30% of the length of the hull measured along the longitudinal axis.

27. A fishing kayak as defined in claim 24, wherein the two pontoon members have inner facing walls and outer facing walls, wherein at least some parts of the outer facing walls of the pontoon members have a tapered shape.

28. A fishing kayak as defined in claim 27, wherein the parts of the outer facing walls of the pontoon members having the tapered shape are located towards the stern end of the body of the fishing kayak.

29. A fishing kayak as defined in claim 24, wherein the convex hull portion is one of an essentially U-shaped portion and an essentially V-shaped portion.

30. A fishing kayak as defined in claim 24, wherein the convex hull portion is an essentially rounded hull portion.

31. A fishing kayak as defined in claim 24, wherein the bow end of the body of the fishing kayak includes a tip, wherein two axes tangential to the tip of the bow end form an angle within which the tip lies, wherein the angle within which the tip lies is an obtuse angle.

32. A fishing kayak as defined in claim 31, wherein the obtuse angle is an angle between about 100 degrees and about 160 degrees.

33. A fishing kayak as defined in claim 24, wherein the seat disposed atop the deck includes a seat bottom and a backrest, wherein the seat is adjustable between an upper and a lower position.

34. A fishing kayak as defined in claim 24, wherein a ratio of a width of an edge of the stern end of the body over a maximal width of the body is at least 0.7.

35. A fishing kayak as defined in claim 24, wherein the convex hull member comprises a ridge that diverges to form ridges of the two pontoon members.

36. A fishing kayak as defined in claim 35, wherein a lowest point of the ridge of the convex hull member is substantially level with the ridges of the two pontoon members in a height direction of the fishing kayak.

37. A fishing kayak comprising:

a body having a bow end and a stern end, the body comprising:

a deck defining a top side of the body of the fishing kayak, wherein a seat is disposed atop the deck;

a hull defining a bottom side of the body of the fishing kayak, the hull comprising:

a pontoon hull portion extending from the stern end of the body to a first intermediate position along a longitudinal axis of the body, the pontoon hull portion being comprised of two pontoon members positioned in an opposing relationship and spaced apart by a concave recess to form a tunnel structure;

a convex hull portion extending towards the bow end of the body from a second intermediate position along the longitudinal axis, wherein the second intermediate position is closer to the bow end of the body than the first intermediate position, said convex hull portion being comprised of a convex hull member positioned substantially along a longitudinal centerline of the body, wherein the convex hull member comprises a ridge that diverges to form a ridge of each of the two pontoon members, wherein a lowest point of the ridge of the convex hull member is substantially level with the ridge of each of the two pontoon members in a height direction of the fishing kayak;

a transitional portion extending between the pontoon hull portion and the convex hull portion along the longitudinal axis, wherein in the transitional portion, the two pontoon members converge into the convex hull portion to form at least in part the convex hull member.

* * * * *